US005079669A

United States Patent [19]

Williams

[11] Patent Number: 5,079,669

[45] Date of Patent: Jan. 7, 1992

[54] ELECTROPHOTOGRAPHIC CHARGING SYSTEM AND METHOD

[76] Inventor: Bruce T. Williams, 454 South St., Lockport, N.Y. 14094

[21] Appl. No.: 335,371

[22] Filed: Apr. 10, 1989

[51] Int. Cl.[5] ..... G03G 15/02

[52] U.S. Cl. ..... 361/235; 355/219

[58] Field of Search ..... 355/219, 221, 222, 225, 355/223; 250/324, 325, 326; 361/230, 235

[56] References Cited

U.S. PATENT DOCUMENTS

| | | | |
|---|---|---|---|
| 3,805,069 | 4/1974 | Fisher | 250/326 |
| 3,986,085 | 10/1976 | Weber | 361/235 |
| 4,019,102 | 4/1977 | Wallot | 355/219 X |
| 4,100,411 | 7/1978 | Davis | 250/326 X |
| 4,140,962 | 2/1979 | Quinn | 250/326 |
| 4,234,249 | 11/1980 | Weikel et al. | 355/222 |
| 4,714,978 | 12/1987 | Coleman | 355/221 X |

*Primary Examiner*—Fred L. Braun

*Attorney, Agent, or Firm*—Hodgson, Russ, Andrews, Woods & Goodyear

[57] ABSTRACT

A system and method for applying charge to a photoconductive surface wherein an electrode is spaced between the surface and a shield including applying a voltage to the electrode such that current therein is the sum of surface charging current and shield current, utilizing the shield current to obtain a signal proportional to the surface charging current and utilizing that signal to control the application of voltage to the electrode. The shield current and the sum of shield current and surface charging current flow in different directions relative to a current summing node and the signal proportional to surface charging current is obtained from the node. That signal is compared to an input control signal to control the application of voltage to the electrode. A high voltage supply has an output, a return input and a control input and variations in a signal applied to the control input cause variations in the output of the supply. The supply output is coupled to the electrode, the current summing node is connected to the return input, and the shield is connected to the summing node so that as the charging current varies as represented by variations in the voltage at the summing node, the control applies a signal to the control input of the supply to control the charging current.

19 Claims, 5 Drawing Sheets

ELECTROPHOTOGRAPHIC CHARGING SYSTEM AND METHOD

BACKGROUND OF THE INVENTION

This invention relates to the art of electrophotography, and more particularly to a new and improved electrophotographic charging system and method.

One area of use of the present invention is in charging a photoconductive surface in an electrophotographic machine, although the principles of the present invention can be variously applied. The typical office copy machine employs the Carlson method of electrophotography, Xerography, to produce a dry, plain paper copy of an original black and white or color document. According to the Carlson method, a photoconductive surface, which can be in drum, sheet, or belt form, is used to produce and store latent images produced from the original. The latent image is produced by a process which charges, i.e. electrifies, the surface of the photoconductor in the dark or high resistance state to a uniform voltage level, typically between 600 and 1000 volts, and then selectively exposes the surface with light from and in registry with the original. The exposure of areas on the surface to light will convert these areas to a lower resistance state to cause discharging of those areas to various voltage levels, the levels being dependent on the intensity of the light from the original. Thus, a latent image is formed which is made up of areas of high voltage corresponding to black levels on the original, medium voltage level areas corresponding to gray levels on the original, and low voltage level areas corresponding to white levels on the original. Subsequent process transfer the latent image to plain paper, using a developer in the form of toner, resulting in a finished copy on plain paper.

To produce good contrast and resolution quality copies, it is important that the system and method for charging the photoconductive surface produce stable charging characteristics as a function of time, temperature, humidity and copy machine age and wear. Furthermore, it would be highly desirable to produce stable charging characteristics independent of spacing variations between the charging device and the photoconductor surface. In addition, it is important to provide the foregoing in a manner which does not produce an undesirable amount of ozone. Related to the foregoing considerations are changes in the magnitude of the electrophotographic surface charging current.

It is, therefore, a primary object of this invention to provide a new and improved electrophotographic charging system and method.

It is a more particular object of this invention to provide such an electrophotographic charging system and method for use in copy machines and other electrophotographic imaging machines which will provide for stable charging the electrophotographic surface to produce stable quality electrophotographic images as a function of time, temperature, humidity, and air pressure.

It is a further object of this invention to provide such a system and method which increases the efficiency of electrophotographic charging used in copy machine and other electrophotographic imaging machines to reduce the cost of machine manufacturing.

It is a further object of this invention to provide such an electrophotographic charging system and method which reduces the amount of ozone produced in electrophotographic machine imaging processes so as to provide less biological hazard and less destruction of machine parts by the corrosive effects of ozone.

It is a further object of this invention to provide such a system and method which reduces the cost of manufacturing of copy and other electrophotographic imaging machines by providing stable electrophotographic surface charging which is independent of the spacing variation between charger and surface, thereby allowing lower tolerances on machine components such as drums, rollers and guides.

It is a further object of this invention to provide such an electrophotographic charging system and method which increases useful life of copy and other electrophotographic machines by making the electrophotographic image or copy quality independent of the variation in mechanical components of the machine due to wear which would cause variation in charger to electrophotographic surface spacing.

It is a further object of this invention to provide such a system and method which reduces the operating costs of a copy or other electrophotographic machine by reducing the maintenance costs required to keep the charging device clean by making the photoconductor charging process independent of the cleanliness of the charging device.

It is a further object of this invention to provide such an electrophotographic charging system and method which provides an electrical signal having a magnitude proportional to the electrophotographic surface charging current.

It is a further object of this invention to provide such a system and method which enables the magnitude of the electrophotographic charging current to be precisely controlled by means of an electrical control signal to provide for quantitative charging of the electrophotographic surface.

The present invention provides a system and method for applying charge to a photoconductive surface wherein an electrode is in proximity to the surface and spaced between the surface and a shield characterized by applying a voltage to the electrode such that current flowing in the electrode is the sum of surface charging current and shield current, utilizing the shield current to obtain an electrical signal proportional to the surface charging current and utilizing that signal to control the application of voltage to the electrode. The shield current is utilized by connecting a current summing node in a circuit including the electrode and the shield such that the shield current and the sum of shield current and surface charging current flow in different directions relative to the node and by obtaining from the node the signal proportional to surface charging current. The signal proportional to surface charging current is compared to an input control signal and the result of the comparison is utilized to control the application of voltage to the electrode.

The foregoing is accomplished by providing a controlled source of charging current having an output connected to the electrode and an input coupled to the shield and being responsive to a control input so that direct control of the charging current is provided by the control input. The controlled source of charging current comprises a high voltage supply having an output, a return input and a control input which operates such that variations in a signal applied to the control input cause variations in the output of the supply, means for coupling the supply output to the electrode, a current summing node connected to the return input, means for connecting the shield to the summing node, and control means having an output connected to the control input of the supply, a first input adapted to receive a control signal, and a second input connected to the summing node so that as the charging current varies, as represented by variations in the voltage at the summing node, the control means applies a signal to the control input of the supply and therefore controls the charging current as determined by the magnitude of the control signal.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

Figure 1:
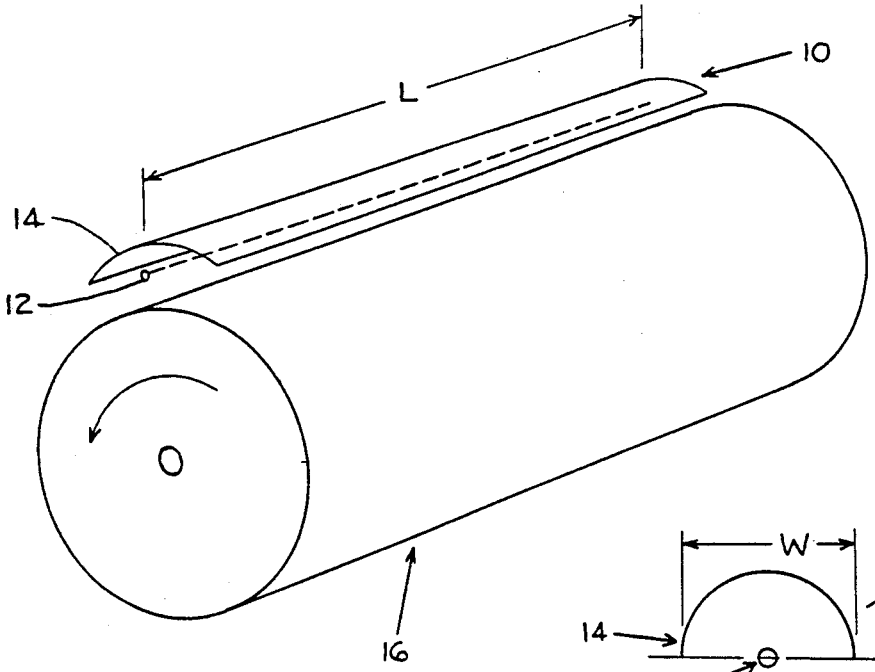
FIG. 1. (PRIOR ART)
FIG. 1 is a diagrammatic perspective view of a prior art electrophotographic charging system and method.

FIG. 1 illustrates a typical prior art electrophotographic charging system which includes a photoconductor charging device 10, called an ionizer, which comprises thin stretched wire 12 and a shielding electrode 14. The air ionizer device 10 is shown in FIG. 1 in the usual position relative to a photoconductor in the form of a drum 16 having a photoconductive surface. Length L of the air ionizer 10 is in the range of length of the drum 16 which varies according to the size of the document to be copied. Width (W) shown in FIG. 1A varies between 1 and 3 inches depending on the type of machine.

Figure 1A:
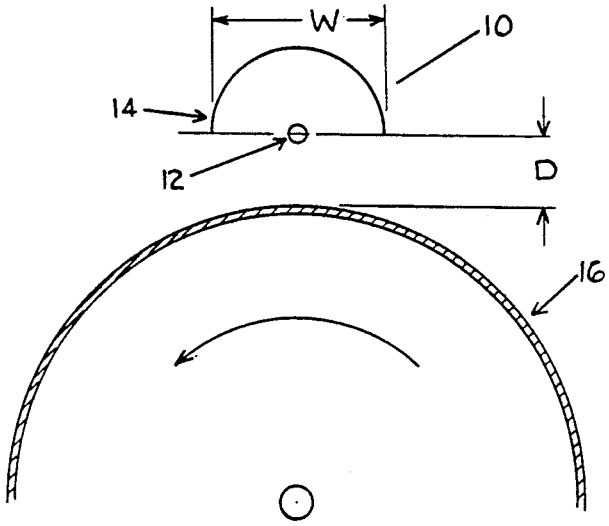
FIG. 1A. (PRIOR ART)
FIG. 1A is a fragmentary end elevational view of the charging system of FIG. 1.
Figure 2:
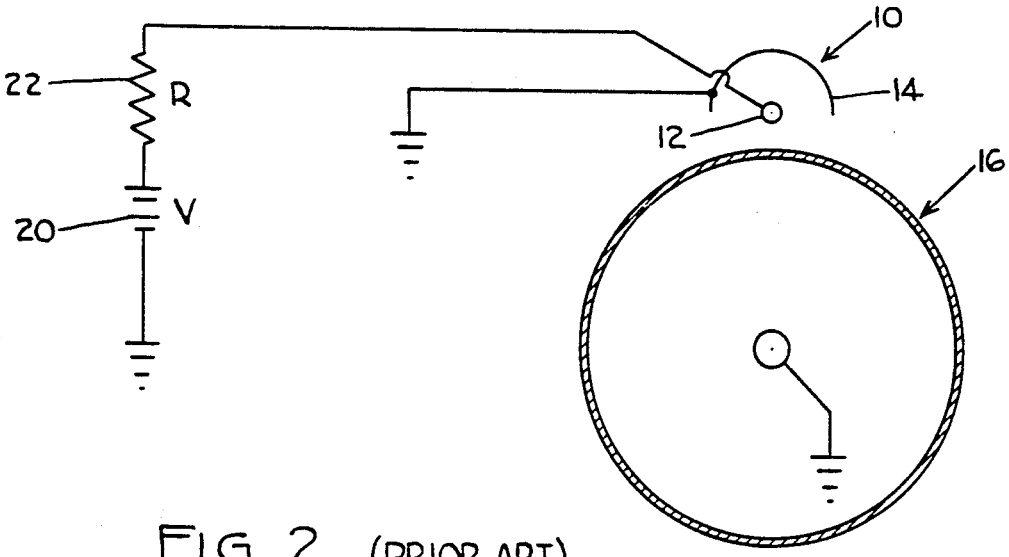
FIG. 2. (PRIOR ART)
FIG. 2 is a schematic diagram showing the charging system of FIG. 1 connected in an electrical circuit.

Wire 12 is typically tungsten for high strength and is supported under the shield 14 by insulating supports (not shown). The distance or spacing (D) between the air ionizer 10 and drum 16 as shown in FIG. 1A is typically in the range of 15 mm. FIG. 2 shows the air ionizer 10 connected to a high voltage supply 20, either positive or negative, to apply to wire 12 a high voltage designated V of typically 4 to 5 kilovolts. Supply 20 is either a constant current type or, as shown in FIG. 2 a constant voltage with a high resistance 22, also designated R, between the output terminal thereof and wire 12 to form a quasi-current source as conventionally known. The shield 14 typically is grounded and is used to generate between the wire 12 and shield a high electrostatic field to encourage air ionization at the wire at voltages of approximately 3 to 4 kilovolts. The shield also prevents the flow of air ions thus produced from flowing in a direction un-productive to drum charging, e.g. away from the drum surface.

Figure 3:
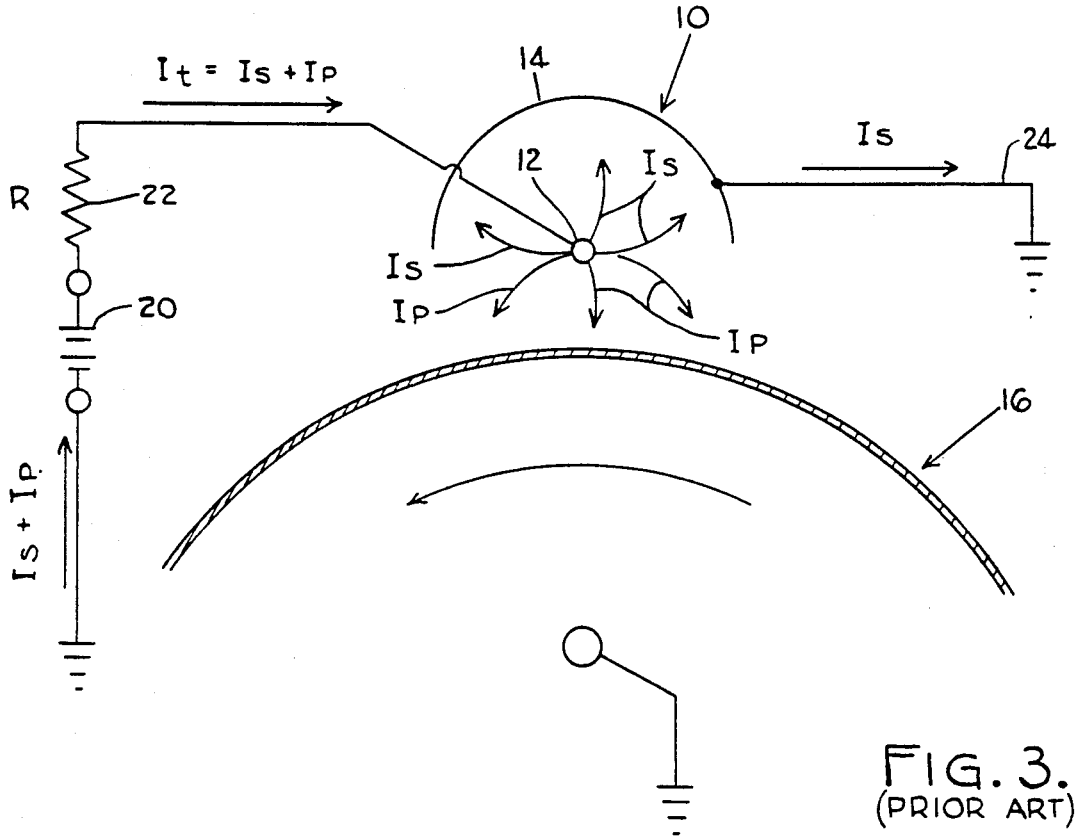
FIG. 3. (PRIOR ART)
FIG. 3 is a fragmentary and enlarged view similar to FIG. 2 and illustrating typical ion current and ion current flow in the air ionizer of the charging system of FIG. 1.

FIG. 3 illustrates typical ion currents and ion current flow in the air ionizing charging system of FIGS. 1 and 2. Ion currents $I_p$ and $I_s$ are shown as arrows leaving the air ionizer wire 12 and flowing to the drum 16 and shield(s) 14, respectively. Durm current $I_p$ is returned to ground through the normally grounded photoconductor drum metal structure. Shield current $I_s$ is returned to ground via a grounding connection 24 to the shield(s). The total current $I_t$, equal to the sum of $I_s$ and $I_p$, e.g. $I_t = I_s + I_p$, is shown flowing from ground through high voltage supply 20 and series resistor 22 to the air ionizing wire 12. This is typical of prior art charging systems.

Figure 4:
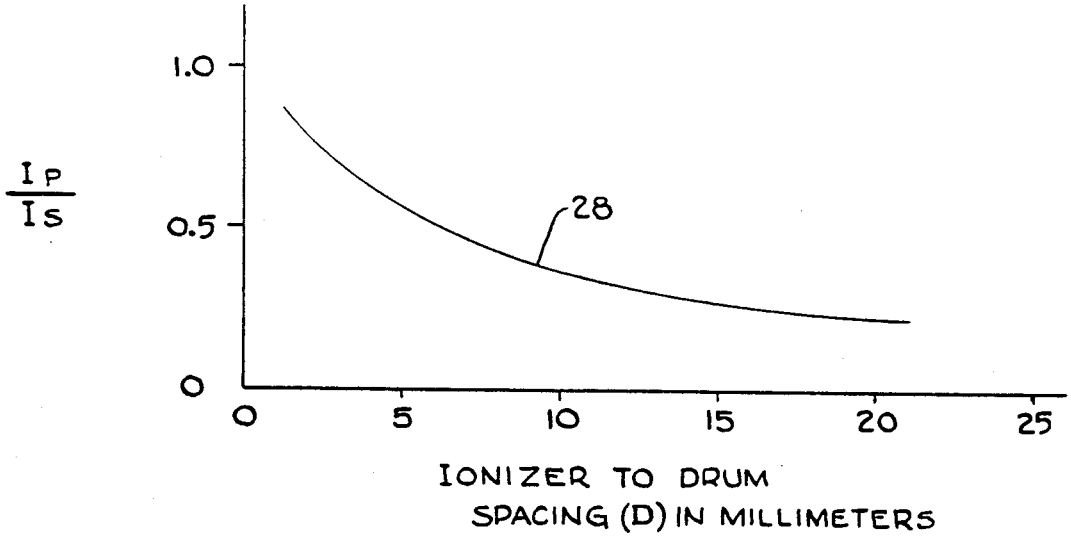
FIG. 4. (PRIOR ART)
FIG. 4 is a graph illustrating proportionality between various ion currents as a function of the distance between charging system and photoconductive surface in the system of FIG. 1.

FIG. 4 is a graph wherein curve 28 represents the proportionality between $I_s$ and $I_p$ as a function of (D), the spacing between the air ionizer 10 and drum 16, as shown in FIG. 1A. At close spacings, e.g. 1 mm, the drum current is approximately 90% of the shield current or approximately 47% of the total current $I_t$. At far spacings, e.g. 20 mm, $I_p$ is approximately 17% of the total $I_t$ current which represents a low drum charging system efficiency, e.g. $I_D/I_t = 17\%$. More important is the slope of the $I_p/I_s$ curve of FIG. 4. At close spacings, the slope is high and therefore only a small change in distance "D" will cause a pronounced change in $I_p$ thus having a large effect on drum charging, copy contrast, resolution and quality. These distance variations (D) are produced by drum "out of roundness", machine wear and looseness.

It is desirable to keep the efficiency of the air ionzier 10 high because ozone, a biological irritant and extremely corrosive chemical, is also produced during the air ionization process. To keep the total amount of produced ozone low, it is desirable to keep the air ionizer efficiency high, e.g., high ratio of $I_p/I_t$, and therefore close air ionizer to drum surface spacings "D" are desired. Unfortunately, the use of close spacings to reduce total ozone production results in high $I_p/I_s$ slopes with resulting more costly machine design to reduce variations in spacing due to mechanical consideration. In typical copy machine prior art designs, all these factors are evaluated to establish a compromise spacing "D".

The variation in $I_p/I_s$ ratio is caused by influence of the electrostatic field on ion mobility. The fixed air ionizer wire 12 to shield 14 distance establishes a fixed electrostatic field in the shield direction while varying air ionizer wire 12 to drum surface 16 spacing causes a change in the field in that direction producing a change in ion mobility with resulting varying ion current flow to the surface.

Another factor affecting the ratio of $I_p/I_s$ is the condition of the air itself between the air ionizer wire 12 and shield 14 and the air ionizer wire 12 and surface 16. The mobility of the ions produced is affected by such factors as air pressure, air temperature and air moisture content (humidity) as conventionally known. If the air between wire, shield and surface is at the same condition, then there is no effect, by air, on $I_p/I_s$ but this condition is difficult to achieve in practice. The air between air ionizer wire 12 and shield 14 being partially enclosed by the shield experiences heating due to the power dissipation in this area. At a wire voltage of 5 kV and a shield current of 100 ua, a 0.5 watts of power is dissipated which raises the air temperature and reduces moisture content. The air between wire 12 and drum surface 16 being constantly circulated by windage caused by drum rotation, machine cooling fans and other machine moving parts tends to be close to atmospheric conditions. This unbalanced air condition situation will change the mobility of the ions to cause a shift in the $I_p/I_s$ ratio over a period of one copy cycle to cause, over a single copy, irregularity in copy quality. Another factor affecting $I_p/I_s$ ratio and therefore copy quality is the cleanliness of the shield electrode 14. During machine use, toner (microspheres of plastic), dust and other contaminants tend to accumulate on the inside surface of the shield 14. These contaminants, being dielectric in nature, tend to charge due to the air ions impinging on them. As they charge toward the potential of the air ionizer wire 12, the electrostatic field between shield 14 and wire 12 is reduced causing a shift in ion mobility and therefore in the $I_p/I_s$ ratio and subsequent copy quality.

Figure 5:
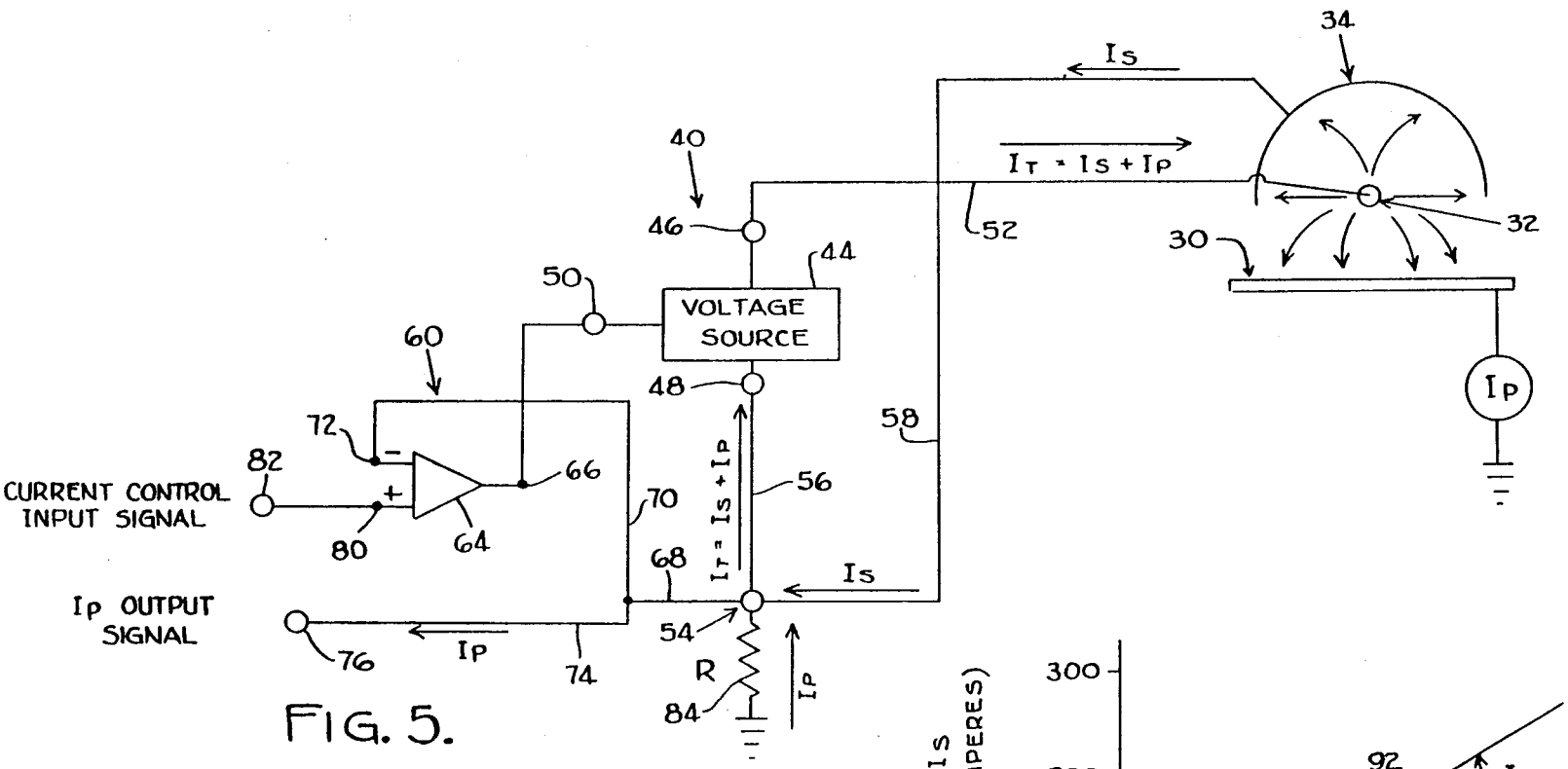
FIG. 5 is a diagrammatic view of an electrophotographic charging system and method according to the present invention.

Referring now to FIG. 5 there is shown an electrophotographic surface charging system according to the present invention. The system applies charge to a photoconductive surface 30 and includes electrode 32 in proximity to surface 30 and a shield 34 spaced from electrode 32 such that electrode 32 is between surface 30 and shield 34. Electrode 32 and shield 34 comprise a typical air ionizer. The system according to the present invention includes a controlled source of charging current generally designated 40 having an output connected to electrode 32, having an input coupled to shield 34 and being responsive to a control input so that direct control of the charging is provided by the control input. In particular, there is provided a high voltage supply 44 having an output 46, a return input 48 and a control input 50 characterized in that variations in the signal applied to input 50 cause variations in the voltage at output 46. Output 46 is connected by means in the form of conductor 52 to electrode 32. There is also provided a current summing node 54 connected by conductor 56 to return input 48 and means in the form of conductor 58 for connecting node 54 to shield 34. The arrangement further includes control means generally designated 60 having an output connected to control input 50 of supply 44, a first input adapted for connection to a control signal and a second input connected to summing node 54 so that as the charging current varies as represented by variations in voltage at summing node 54 the control means 60 applies a signal to control input 50 of voltage supply 44 to control the output of supply 44 and therefore the magnitude of the charging current as determined by the magnitude of the control signal.

Control means 60 includes an amplifier 64 in the form of a low voltage operational amplifier having the output 66 thereof connected to control input port 50 of high voltage supply 44. This connection provides for the control of the voltage output of high voltage supply 44 by amplifier 64. The means by which amplifier 64 controls the output voltage of supply 44 can take various forms, such as low voltage primary side control if high voltage supply 44 is a D.C. to D.C. converter, use of high voltage opto-couplers for secondary side control of the output of supply 44, or use of bootstrapping control of supply 44 by an auxiliary supply controlled by amplifier 64. Additionally, if high voltage supply 44 is an A.C. line powered type, amplifier 64 could control the A.C. signal applied to the primary of the power transformer by either saturable reaction or peak waveform limiting control. For purposes of description, it is assumed that the connection of amplifier 64 to the control port 50 of high voltage supply 44 is such that as the output signal of amplifier 64 varies, the output of supply 44 varies. The return line 56 connected to return input 48 of supply 44 has a current $I_t$ flowing therein where $I_t$ is the total of the shield(s) current $I_s$ and electrophotographic current $I_p$; i.e., $I_t=I_s+I_p$. As shown in FIG. 5, return terminal 48 of high voltage supply 44 is connected to current summing node 54, and also connected to the current summing node 54 is a connection to the air ionizer shield(s) by means of conductor 58. This is in contrast to prior art systems wherein the shield is normally grounded. Also connected to summing node 54 is a connection via conductors 68 and 70 to the inverting terminal 72 of amplifier 64 and a connection via conductors 68 and 74 to a terminal 76, a terminal used for external monitoring. The plus terminal 80 of amplifier 64 is connected to a voltage input terminal 82 which applies to the plus input of amplifier 64 a current control signal in the range of from 0 to about 10 volts for purposes of illustration. An impedance in the form of resistor 84 having a magnitude R is connected from summing node 54 to circuit common.

The current $I_t=I_s+I_p$ is flowing out of node 54 because of the connection of node 54 to return terminal 48 on high voltage supply 44 as shown by the arrow labeled $I_t$ along conductor 56. Flowing into node 54 is current $I_s$ because of the connection of node 54 to the ionizer shield(s) as shown by the arrow labeled $I_s$ along conductor 58. The difference in current, therefore, flowing from node 54 to ground through resistor 84 is $I_t-I_s$. In particular, this difference in current is $I_s+I_p-I_s=I_p$ as shown by the arrow labeled $I_p$ along resistor 84. There will, therefore, be generated across resistor 84 a voltage equal to $I_p$ R. This voltage is connected by lines 68 and 74 to terminal 76 thus providing an electrical signal whose magnitude is proportioned to the electrophotographic charging current $I_p$, an object of this invention. Thus, the shield current $I_s$ is utilized in the foregoing manner to obtain an electrical signal proportional to the surface charging current $I_p$.

The voltage developed at node 54, equal to $I_p$ R, is also applied by conductor 70 to the negative input 72 of amplifier 64. Amplifier 64 compares this voltage to the current control input signal applied to the plus input 80 of the amplifier from terminal 82, the current control input signal. If these signals at the plus and negative inputs of amplifier 64 are not equal, the amplifier output voltage will change the voltage at the high voltage supply control port 50 to cause the high voltage supplied to the air ionizing wire 32 to change.

The change in air ionizing wire voltage will change the electrophotographic charging current $I_p$ in the direction necessary to cause the voltage generated at node 54 and therefore the negative input 72 of amplifier 64 to exactly match the voltage at the plus input 80 of the amplifier 64, i.e., the current control input signal. For example, if a voltage of +5 volts is applied to the current command input terminal 82 and the value of resistor 84 is 100 k ohms, then amplifier 64 together with high voltage supply 44 will apply a voltage to the air ionizer wire 32 which will cause $I_p$ to be 50 microamperes. In this way, direct control of the electrophotographic current is provided by the current command input voltage at terminal 82 thus providing quantitative control of the electrophotographic charging current, an object of this invention.

Figure 6:
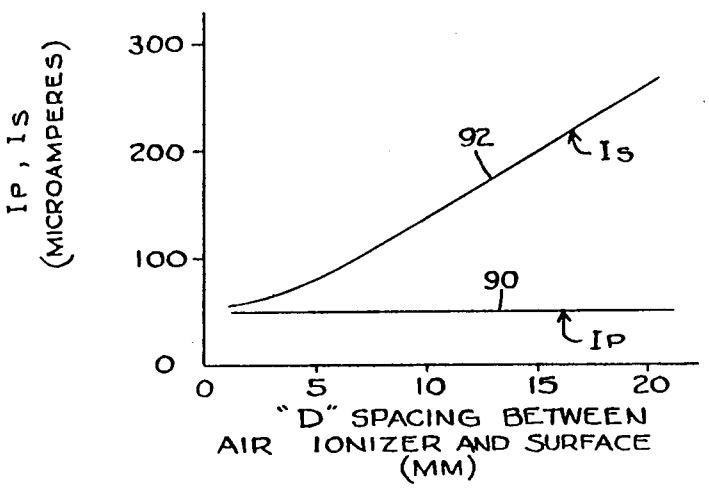
FIG. 6 is a graph illustrating the magnitudes of various ion currents as a function of the distance between charging system and photoconductive surface in the system of FIG. 5.

If $I_p$ tries to vary from the 50 microampere level, for example by a change in the distance between the air ionizer and surface 30, or accumulation of dielectric contaminants on air ionizer shield(s) 34, amplifier 64 will sense the change of voltage on node 54 and automatically adjust the air ionizer wire voltage to maintain the 50 microampere level. This is shown in FIG. 6 where a graph of $I_p$ (electrophotographic surface current) v.s. air ion to surface spacing is shown by curve 90. Also shown in FIG. 6 is the $I_s$ v.s. spacing plot represented by curve 92. Thus, when the air ionizer to surface D changes from 1 mm to 20 mm, the electrophotographic charging current $I_p$ stays fixed at 50 microamperes, while the shield current $I_s$ varies from 55 microamperes to 250 microamperes.

Using the electrophotographic charging system of the present invention in a copy machine or other electrophotographic imaging machine, at a closing spacing of 1 mm to 5 mm, will result in an $I_t$ current of between 105 and 140 microamperes which represents charger efficiencies of between 36% and 47%, an improvement of 2 to 3 over prior art chargers, which opperate at approximately 17%. In addition, because of the high efficiency, the amount of ozone produced is 2 to 3 times less than prior art devices, therefore reducing the biological and corrosion effects of ozone. Thus, major objects of this invention are accomplished.

In addition, because spacing variations between the air ionizer and electrophotographic surfaces in the system of this invention do not change the electrophotographic charging current, less expensive machine design and/or drum design can be used without affecting electrophotographic copy or image quality. Also, longer life of the copy or other electrophotographic imaging machine is obtained by the charging system of this invention due to its tolerance of out-of-roundness, out of flatness and/or other machine mechanical variations due to wear and age. Furthermore, variations in electrophotographic charging current due to variations in the air condition such as air pressure, temperature, and humidity which cause charging variations in prior art designs are eliminated with the charging system of this invention. In addition, maintenance costs which are required to keep the air ionizer clean in prior art charging systems, are reduced by employment of the charging system of this invention by making the electrophotographic surface charging system, as established by the current control input voltage, independent of the contamination of the air ionizer components.

Figures 7, 8:
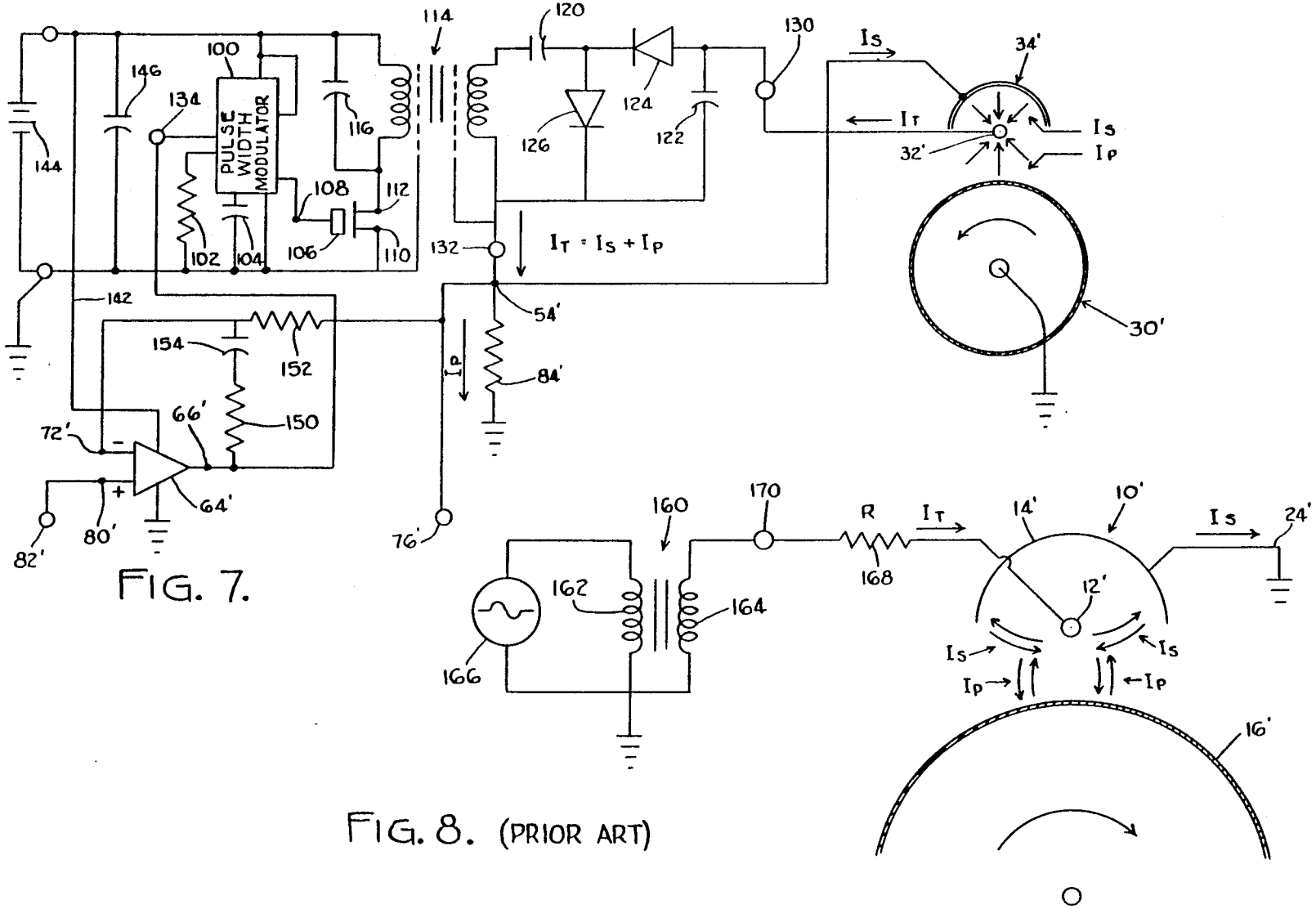
FIG. 8. (PRIOR ART)
FIG. 7 is a schematic diagram of an electrophotographic charging system and method according to another embodiment of the present invention.
FIG. 8 is a diagrammatic view of another form of prior art electrophotographic charging system for removing charge from the surface.

FIG. 7 illustrates a charging system according to another embodiment of the present invention which operates from a 24 volt supply. It features high efficiency due to the use of a high operating frequency pulse width modulated high voltage supply for air ionizer wire excitation without the use of a series dropping resistor included in the prior art system shown in FIGS. 2 and 3. The system of this embodiment outputs negative voltages into the air ionizer to produce negative electrophotographic charging. Components in the system of FIG. 7 which are identical to these in the system of FIG. 5 are identified by the same reference numerals with a prime designation. Thus, summing node 54 corresponds to summing node 54' in FIG. 5. The system of this embodiment includes a typical pulse width modulating integrated circuit 100 operation at a fixed frequency as chosen by resistor 102 and capacitor 104 to drive a pulse amplifier 106. Amplifier 106 is a field effect transistor type power device having gate, source and drain terminals 108, 110 and 112, respectively. The primary of transformer 114, with capacitor 116, forms a ringing inductor circuit, the ringing amplitude of which is dictated by the width of the current pulse at the drain 112 of F.E.T. amplifier 106 to vary the amplitude of the high voltage generated by the secondary of transformer 114 and a voltage multiplier circuit comprising capacitors 120, 122 and diodes 124, 126 connected across the transformer secondary. The terminals 130, 132 and 134 of the high voltage supply and pulse width modulator correspond in function to terminals 46, 48 and 50 in FIG. 5. The system also includes an operational amplifier 64' and operating power is obtained directly via line 142 from a 24 volt supply 144. A filter capacitor 146 connected across supply 144 provides a stiff impedance for the primary circuit of transformer 114 and filters any noise from the 24 volt supply 144. A network connected to amplifier terminals 66' and 72' and comprising resistors 150, 152 and capacitor 154 establishes the dynamic performance of the system to obtain fast response which is free of oscillation. Resistor 84' is the electrophotographic surface charging current sense resistor and is connected between current summing node 54' and ground as in the system of FIG. 5. The current command signal is applied to terminal 82' and the output signal is available on terminal 76'. The circuit of FIG. 6 is illustrative of various alternative forms of the system according to this embodiment of the present invention.

By way of example, in an illustrative circuit, pulse width modulating integrated circuit is industry standard type TL 494, resistor 102 has a magnitude of 10K, capacitor 104 has a magnitude of 0.01 microfarad, field effect transistor amplifier 106 is International Rectifier type IRF613, transformer 114 is a fly-back type having primary:secondary turns ratio of 70:1 and operating at 18 kHz, capacitor 116 has a magnitude of 0.01 microfarad, capacitors 120 and 122 each have a magnitude of 120 picofarad, source 144 is a 24 volt d.c. supply, capacitor 146 has a magnitude of 1000 microfarads, resistors 150 and 152 have magnitudes of 1k and 10K, respectively, capacitor 154 has a magnitude of 0.01 microfarad, amplifier 64' is industry standard type LF356, and resistor 84' has a magnitude of 100K.

In copying machines and other electrophotographic imaging machine processes, it is essential that the voltage level of the electrophotographic surface be at a known uniform level before charging by the charging air ionizer to the pre-exposure level to insure charging to a uniform level. Typically, zero is preferred as the known uniform level. Conventionally, a high voltage A.C. signal, at 500 to 1000 Hz, is applied to an air ionizer to generate positive and negative air ions which are used to "flood" the surface to erase any charges left after the image transfer cycle, thereby driving the surface to zero in preparation for the following charging cycle by the charging air ionizer. In the "flooding" process, positive air ions will be drawn by and combined with negative charges on the electrophotographic surface to cancel these surface charges to zero, while negative air ions will combine with positive surface charges for similar cancellation.

It is known that the efficiency of the air ionizer when generating negative air ions is higher than when generating positive air ions. Therefore, it is conventionally anticipated that when driving air ionizers with A.C. wave forms for the purpose of generating positive and negative air ions, high voltage current sources are preferred over voltage sources to help maintain the balance between the number of negative ions generated as compared to positive ions to reduce charging of the electrophotographic surface which occurs if there is a plurality of one kind of ion over the other. If an ion imbalance exists, effective erasure of the surface to near zero potential is not obtained.

FIG. 8 shows a typical prior art A.C. air ionizing system for discharging an electrophotographic surface. Components similar to those of of the system of FIGS. 1–4 are identified by the same reference numerals having a prime designation. A step-up high voltage transformer 160 having primary and secondary windings 162 and 164, respectively, is connected to an A.C. signal source 166 of approximately 500 to 1000 Hz. A high megohm resistor 168 having magnitude R of approximately 5–10 megohms, is used to help cause the A.C. current $I_t$ to be relatively constant in amplitude (both positive and negative) regardless of the effect of different efficiencies of the air ionizer to positive and negative polarities of voltage developed at the output of terminal 170 of transformer 160. This system is inefficient because of the use of resistor 168 due to the power dissipated across resistor 168 equal to $I_t R$. In addition, because the combination of the transformer output voltage and R is only a quasi-constant current supply, as conventionally known, the positive and negative currents and therefore the quantity of positive ions and negative ions generated will not be identical thus leaving a small non-zero charge on the electrophotographic surface 16'. To eliminate the undesirable effects of low efficiency and non-zeroing by the prior art discharging device, the system of the present invention can be effectively used. In particular, as provided by the system and method of this invention, the current (ion flow) between the air ionizer 10' and electrophotographic surface 16' can be precisely measured and controlled by a current command signal. If the current command signal is zero, then the average of value of $I_p$ current must also be zero.

Figure 9:
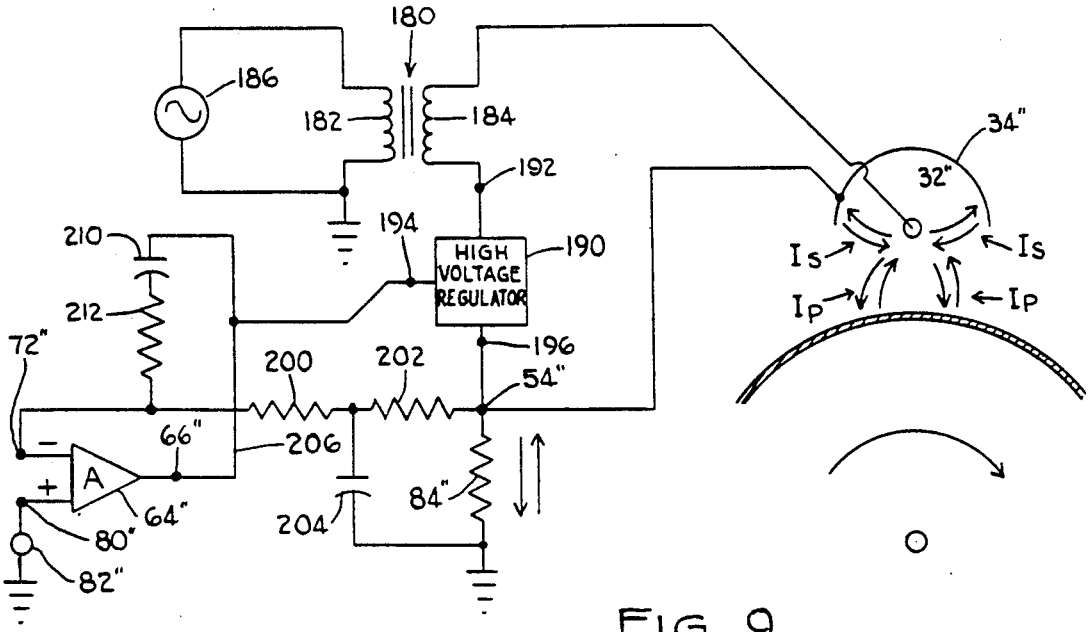
FIG. 9 is a diagrammatic view of an electrophotographic charging system and method according to another embodiment of the present invention for removing charge from a surface.

FIG. 9 illustrates an A.C. air ionizer discharging system according to the present invention which can be used for electrophotographic surface erasure in copy and other electrophotographic imaging machine processes. This system is of high efficiency due to the absence of a series dropping resistance and will produce a zero average ion current ($I_p$) flow to the electrophotographic surface 30" to prevent surface charging. In the system of FIG. 9 components similar to those of the system of FIG. 5 are identified by the same reference numerals having a prime designation. A step-up high voltage transformer 180 having primary and secondary windings 182 and 184, respectively, is connected to an A.C. signal source 186 of approximately 600 Hz. This transformer is smaller and lighter than the transformer used in the prior art system of FIG. 8 because of higher system efficiency due to the absence of the series resistor 168 included in the system of FIG. 8. A high voltage supply 190 of approximately 0 to +1 kV has an output 192 connected to apply a bias voltage to the return connection of the high voltage secondary winding 184 at output terminal 192 in response to a control signal at input terminal 194 from the output of amplifier 64". Thus, voltage supply 190 is similar to voltage supply 44 in the system of FIG. 5. The shield(s) 34" of the air ionizer is connect to the summing point 54" together with the return line from supply terminal 196, a connection through resistors 200 and 202 to the negative input terminal 72" of amplifier 64", and resistor 84" which terminates at ground. The positive input terminal 80" of amplifier 64" is connected to the current command input terminal 82" which is shown connected to ground (0 volts). A capacitor 204 is connected across the combination of resistors 202 and 84", and capacitor 204 together with resistor 202 filters out the A.C. component of $I_p$ monitored across resistor 84" to apply to the negative input 72" of amplifier 64" the average value of $I_p$ current. The output 66" of amplifier 64" is connected by line 206 to input terminal 194 of supply 190, and terminal 194 also is connected by the combination of capacitor 210 and resistor 212 to the negative input terminal 72" of amplifier 64". The system of FIG. 9 will function to cause the average value of $I_p$ to be driven to the voltage value applied to the current command signal, which in this case is zero by virtue of the connection of current command input terminal 82" to ground. If the average value of $I_p$ tries to depart from zero due to the tendency of the air ionizer to produce more negative ions than positive ions, this change will be detected by amplifier 64" which will change the output of supply 190 via control port 194 to apply a bias voltage to the air ionizer wire 32" to correct the ion production imbalance to keep the average positive and negative ion flow $I_p$ to the surface 30" at zero.

The addition of the bias voltage to the wire 32" of the air ionizer will shift the relative values of A.C. voltages applied to wire 32". For example, if the output of transformer 180 is a 9 kV peak to peak A.C. signal, with the output of supply 190 at zero, the air ionizer wire voltage will be 0 to +4.5 kV to generate positive ions and 0 to −4.5 kV to generate negative ions. This will produce an excess of negative ions because of the higher efficiency of the air ionizer when producing negative ions. This will result in a non-zero $I_p$ value which will be measured across resistor 84" and at the negative point of amplifier 64". In response to a positive voltage at the amplifier negative input terminal 72", the circuit will cause the output of amplifier 64" to adjust the voltage at port 194 of supply 190 to cause the supply to apply via output terminal 194 to the transformer secondary return a positive bias voltage of say +500 volts. The voltage supplied by the transformer secondary 184 will still be 9 kV peak to peak, but because of the +500 volt bias level from the supply 190, the air ionizer wire 32" will see a voltage of +500 to +5.0 kV to generate positive ions and +500 to −4 kV to generate the negative ions. This increased positive voltage excursion and reduced negative voltage excursion relative to the near ground potential of the shield will cause an increase of positive ion production and decreased negative ion production, respectively, thereby cancelling the non-linear ion production effects of the air ionizer and producing equal numbers of positive and negative ions. This system will therefore adjust the output bias voltage supply 190 to cause the average electrophotographic current $I_p$ to be driven to the value dictated by the current command signal at the current command input, which in this case is zero.

Although a sinusoid waveform has been shown as the source for the transformer primary voltage, other waveforms such as square waves could be used with this system equally well. Although in this embodiment a zero current command signal was used, other non-zero values could be applied to causes a non-zero electrophotographic current controlled by the current control signal if desired.

By way of example in an illustrative circuit A.C. source 186 provides an output of 115 volts a.c. at 60 Hz, transformer 180 is high voltage step-up type with a secondary rating of 5 kilovalts rms, source 190 is an inverting type d.c. to d.c. converter voltage supply to produce a voltage output between 0 and +1 kv d.c. in response to an input of 0 to −10 volts from amplifier 64'', amplifier 64'' is an operational amplifier typeLM356, resistor 84'' has a magnitude of 100K, resistors 200 and 202 each have a magnitude of 10K, capacitor 204 has a magnitude of 2 microfarads, capacitor 210 has a magnitude of 0.1 microfarads and resistor 212 has a magnitude of 1K.

Figure 10:
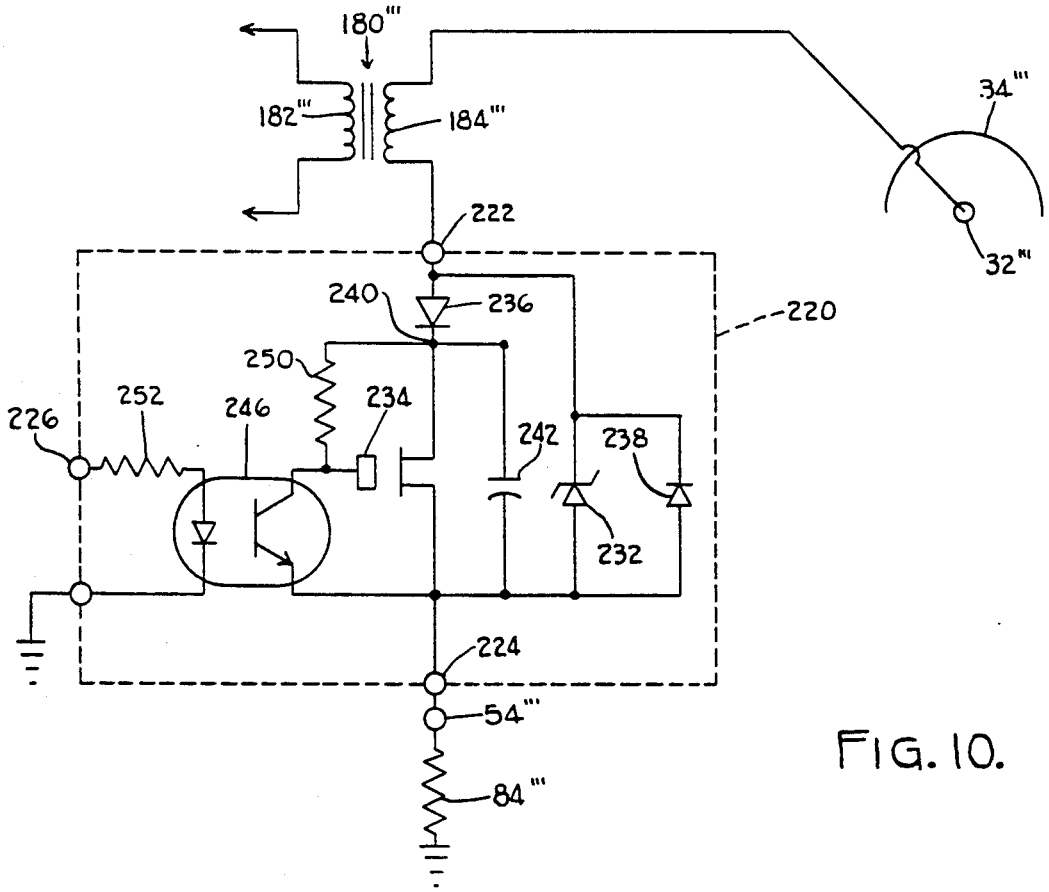
FIG. 10 is a schematic diagram of an alternative voltage supply circuit for the system of FIG. 9.

Although voltage source 190 is included in the system of FIG. 9 as a separate supply, the bias voltage could be produced by replacing supply 190 with a nonlinear device in the secondary return line of transformer 180 which employs the secondary winding current itself to generate the bias voltage which is controlled by the output of amplifier 64''. Such an alternative is illustrated in the circuit of FIG. 10 wherein components similar to those in the circuit of FIG. 9 are identified by the same reference numerals having a triple prime designation. The controlled voltage source 220 includes the components within the box designated by the broken lines in FIG. 10. The controlled supply 220 has an output terminal 222, a return terminal 224 and a control input terminal 226. In the arrangement of FIG. 10, a zener type diode 232 protects the F.E.T. type transistor 234 from voltage stress. Diodes 236 and 238 are provided so as not to allow output terminal 222 to go to a voltage below that of circuit point 240 by more than about one volt, or above the bias level established across capacitor 242 by conduction of transistor 234 at a voltage level dictated by transistor 234, resistor 84''' and the transistor section of an optocoupler 246 connected between control input terminal 226 and transistor 234. A voltage-dropping resistor 250 is connected between the gate terminal of transistor 234 and point 240. A current-developing resistor 252 is connected between input terminal 226 and the light-emitting diode component of optocoupler 246.

When transformer 180''' applies the negative voltage portion of the A.C. waveform to the air ionizer, supply output terminal 222 goes positive to a voltage value dictated by the turn-on voltage of transistor 234 (about 2 volts), the value of resistor 84''' and the current through the transistor portion of the optocoupler 246. This voltage level is stored in the capacitor 242 to generate the bias voltage between output terminal 222 and point 240. For example, if resistor 250 has a magnitude of 1 megohm and the current through the optocoupler transistor is 500 a, then output terminal 222 will rise to +502 volts before transistor 234 is turned on. Thus, an equivalent +502 volt bias is generated between terminal 222 and point 240. Higher or lower values of voltage at input port 226 from the amplifier, i.e. amplifier 64'' of FIG. 9, will cause higher or lower values of opto-transistor current and higher or lower value of bias voltage respectively. In the circuit of FIG. 10, resistor 252 is used to conver the voltage output of the amplifier, i.e. amplifier 64'' in FIG. 9, to a current which flows through the diode portion of the optocoupler 246 which is translated to a current in the transistor portion of the optocoupler as is well known. In this circuit, all current flowing to output terminal 222 appears at point 240 because of no other direct circuit connections and is available for measurement at point 54''. By way of further example, in the foregoing illustrative circuit, capacitor 242 has a magnitude of 0.1 microfarad, transistor 234 is a high voltage MOSFET type BU253, optocoupler 246 is type H11A1, and resistor 252 has a magnitude of 10K.

It is therefore apparent that the present invention accomplishes its intended objects. The system and method for charging a photoconductive surface produces stable charging characteristics as a function of time, temperature, humidity and system age and wear. Stable charging characteristics are produced independent of spacing variations between the charging device and the photoconductive surface. The foregoing is provided in a manner which does not produce an undesirable amount of ozone. In connection with the foregoing, the system and method of the present invention provides an electrical signal having a magnitude proportional to the electrophotographic surface charging current, and the system and method enables the magnitude of the charging current to be precisely controlled by the means of an input electrical control signal to provide for quantitative charging of the surface.

While embodiments of the present invention have been described in detail, this is for the purpose of illustration, not limitation.

I claim:

1. A system for applying charge to a photoconductive surface including electrode means in proximity to the surface and shield means spaced from said electrode means such that said electrode means is between the surface and said shield means:

a) a controlled source of charging current having an output coupled to said electrode means and having an input connected to said shield means and being responsive to a control input so that direct control of the charging current is provided by said control input;

b) means for applying said control input to said controlled source of charging current; and c said shield means being connected to said controlled source of charging current so that said charging current is maintained constant as the distance between said surface and said electrode and shield varies.

2. A system according to claim 1, wherein said means for applying said control input includes means providing a control signal of predetermined magnitude so that said controlled source provides charging current having a magnitude determined by the magnitude of said control signal.

3. A system according to claim 1, wherein said means for applying said control input includes means providing a zero magnitude input signal so that said controlled source provides zero average charging current to said surface.

4. A system for applying charge to a photoconductive surface wherein an electrode is in proximity to the surface and spaced between the surface and a shield comprising:

a) means for applying voltage to said electrode such that current flowing in said electrode is the sum of surface charging current and shield current;

b) signal developing means operatively connected to said shield for utilizing said shield current for obtaining an electrical signal proportional to said surface charging current; and c) control means operatively connected to said signal developing means and connected in controlling relation to said voltage applying means for controlling the application of voltage to said electrode;

d) so that said surface charging current is maintained constant as the distance between said surface and said electrode and shield varies.

5. A system according to claim 4, wherein said signal developing means comprises:

a) a current summing node connected in a circuit including said electrode and said shield in a manner such that said shield current and said sum of shield current and surface charging current flow in different directions relative to said node; and b) means connected to said node for obtaining from said node said signal proportional to said surface charging current.

6. A system according to claim 4, wherein said control means comprises:

a) comparison means having a pair of inputs and an output;

b) means for connecting one of said inputs to said signal developing means;

c) means for connecting the other of said inputs to a control signal; and d) means for connecting said output to said voltage applying means for controlling application of voltage to said electrode as a result of comparison between said inputs.

7. A system for applying charge to a photoconductive surface including electrode means in proximity to the surface and shield means spaced from said electrode means such that said electrode means is between the surface and said shield means:

a) high voltage supply means having an output, a return input and a control input such that variation in a control signal applied to said control input causes variation in the voltage of said output;

b) means for coupling said output of said supply means to said electrode means;

c) means defining a current summing node connected to said return input;

d) means for connecting said shield means to said summing node; and e) control means having an output connected to said control input of said supply means, a first input adapted to receive a control signal and a second input connected to said summing node so that shield current flows from said shield means to said summing node and the sum of said charging current and shield current flows from said summing node and so that as charging current for said surface varies as represented by variations in voltage at said summing node said control means applies a signal to said control input of said supply means to control the output of said supply means and thereby said charging as determined by the nature of said control means.

8. A system according to claim 7, wherein said control means comprises an operational amplifier.

9. A system according to claim 7, further including resistance means connected to said current summing node for developing a voltage to provide a signal proportional to the electrophotographic charging current for said surface.

10. A system according to claim 7, wherein said high voltage supply means comprises a high operating frequency pulse width modulated high voltage supply having an output connected directly to said electrode means.

11. A system according to claim 10, wherein said pulse width modulated supply comprises:

a) a transformer having primary and secondary windings;

b) a pulse width modulator having an input connected to said output of said control means and an output connected to said transformer primary winding; and c) a voltage multiplier network connected between said transformer secondary winding and said electrode means.

12. A system according to claim 11, further including:

a) field effect transistor means connected to said pulse width modulator and to said transformer primary winding; and b) means for connecting said transformer secondary winding to said summing node.

13. A system according to claim 7, further including means for connecting said first input of said control means to electrical ground so that zero average ion current flows to said surface.

14. A system according to claim 13, wherein said means for coupling said output of said supply means to said electrode means comprises:

a) a transformer having a primary winding and having a secondary winding connected in series between said output of said supply means and said electrode means; and b) an a.c. signal source connected across said transformer primary winding.

15. A system according to claim 14, wherein said supply means comprises a non-linear device which employs current in said secondary winding to generate bias voltage for application to said electrode means.

16. A method for applying charge to a photoconductive surface wherein an electrode is in proximity to the surface and spaced between the surface and a shield comprising the steps of:

a) applying a voltage to said electrode such that current flowing in said electrode is the sum of surface charging current and shield current;

b) utilizing said shield current to obtain an electrical signal proportional to said surface charging current; and c) utilizing said signal to control the application of voltage to said electrode;

d) so that said surface charging current is maintained constant as the distance between said surface and said electrode and shield varies.

17. A method according to claim 16, wherein said step of utilizing said shield current comprises the steps of:

a) connecting a current summing node in a circuit including said electrode and said shield such that said shield current and said sum of shield current and surface charging current flow in different directions relative to said node; and b) obtaining from said node said signal proportional to said surface charging current.

18. A method according to claim 17, wherein said signal proportional to surface charging current is obtained by connecting resistance means to said node to develop a voltage signal proportional to said surface charging current.

19. A method according to claim 16 wherein said step of utilizing said signal to control application of voltage to said electrode comprises:

a) comparing said signal to an input control signal; and b) utilizing the result of said comparison to control said application of voltage.

* * * * *